US005699970A

United States Patent [19]

Mihailovic

[11] Patent Number: 5,699,970

[45] Date of Patent: Dec. 23, 1997

[54] MEAT-COMMINUTING MACHINE WITH IMPROVED VACUUM DISCHARGE MECHANISM

[75] Inventor: Vladan Mihailovic, Chicago, Ill.

[73] Assignee: 2 M Tool Co., Inc., Chicago, Ill.

[21] Appl. No.: 678,175

[22] Filed: Jul. 11, 1996

[51] Int. Cl.[6] ..... B02C 13/02

[52] U.S. Cl. ..... 241/82.5; 241/82.4; 241/185.6

[58] Field of Search ..... 241/82.4, 82.5, 241/82.1, 82.6, 185.5, 185.6, 186.5, 46.11, 46.17

[56] References Cited

U.S. PATENT DOCUMENTS

| | | | |
|---|---|---|---|
| 2,245,035 | 6/1941 | Hartman | 241/185.6 X |
| 2,371,681 | 3/1945 | Durdin, Jr. | 241/185.6 X |
| 2,824,702 | 2/1958 | Lee | 241/46 |
| 3,076,488 | 2/1963 | Illsley et al. | 241/82.5 X |
| 3,096,718 | 7/1963 | Anderson | 241/185.6 X |
| 3,128,051 | 4/1964 | Smith | 241/185.6 X |
| 3,155,046 | 11/1964 | Vaughan | 241/185.6 X |
| 4,004,742 | 1/1977 | Hess | 241/82.5 |
| 4,153,208 | 5/1979 | Vomhof et al. | 241/82.4 X |
| 4,240,591 | 12/1980 | Schnell | 241/82.4 |
| 4,482,095 | 11/1984 | Danforth | 241/46.11 |
| 4,483,095 | 11/1984 | Nishimori | 241/46.11 X |
| 4,902,522 | 2/1990 | Rudibaugh | 426/231 |
| 5,092,528 | 3/1992 | Rudibaugh | 241/82.5 X |
| 5,332,163 | 7/1994 | Schnizler | 241/185.6 X |

FOREIGN PATENT DOCUMENTS

| | | | |
|---|---|---|---|
| 0 249 840 | 12/1987 | European Pat. Off. | 241/82.5 |
| 0 420 001 | 4/1991 | European Pat. Off. | 241/82.5 |

OTHER PUBLICATIONS

One sheet containing four photographs depicting rotors for a meat comminuting machine of admitted prior art.

*Primary Examiner*—Daniel W. Howell
*Assistant Examiner*—Julie A. Krolikowski
*Attorney, Agent, or Firm*—Dressler, Rockey, Milnamow & Katz, Ltd.

[57] ABSTRACT

A discharge mechanism for meat-comminuting machine is disclosed, which comprises a housing structure and a discharge rotor. The housing structure defines a discharge chamber adapted to receive meat comminuted by the meat-comminuting machine, through a front mouth of the discharge chamber, and defines a back wall of the discharge chamber and a cylindrical wall thereof. The discharge rotor is arranged to be rotatably driven in the discharge chamber for discharging the comminuted meat from the discharge chamber, through an outlet of the cylindrical wall, via centrifugal force. The discharge rotor has a hub extending axially, an annular flange extending radially from a back end of the hub and having an inner, circumferential edge and an outer, circumferential edge, which is close to but spaced by a circumferential gap from the other, circumferential wall, and fins extending radially from the hub, toward the other, circumferential edge, and axially from a front face of the annular flange, toward a front end of the hub. The discharge rotor has formations on the back face of the annular flange, either spiral grooves or spiral ribs, for removing any comminuted meat tending to accumulate between the back face of the annular flange and the back wall of the discharge chamber structure by displacing the tending-to-accumulate meat radially outwardly toward the outer, circumferential edge of the annular flange, via centrifugal force. The hub has a hollow portion opening backwardly. A tube extending into the discharge chamber, through a hole in the back wall of the discharge chamber, into the hollow portion of the hub is used for drawing a partial vacuum within the discharge chamber.

8 Claims, 5 Drawing Sheets

MEAT-COMMINUTING MACHINE WITH IMPROVED VACUUM DISCHARGE MECHANISM

TECHNICAL FIELD OF THE INVENTION

This invention pertains generally to a meat-comminuting machine and particularly to an improved discharge mechanism for a meat-comminuting machine. The improved discharge mechanism is equipped with novel means for removing comminuted meat tending to accumulate between a discharge rotor and a back wall of a discharge chamber.

BACKGROUND OF THE INVENTION

Various models of meat-comminuting machines in widespread use in the United States of America and other countries have been available from Mince Master Division of 2 M Tool Company, Inc. of Chicago, Ill., under its MINCE MASTER trademark, since 2 M Tool Company, Inc., acquired relevant assets from Griffith Laboratories U.S.A. of Chicago, Ill. Such meat-comminuting machines are exemplified in prior patents including U.S. Pat. No. 2,840,318, Re. 24,764, No. 2,906,310, No. 2,934,120, No. 2,934,121, No. 2,952,288, No. 3,019,067, No. 3,044,514, and No. 3,149,653.

Typically, such a meat-comminuting machine is arranged to force meat that has been comminuted by the meat-comminuting machine through perforations in a perforated plate, into a discharge mechanism comprising a housing structure and a discharge rotor. Typically, the housing structure defines a discharge chamber adapted to receive the comminuted meat from the perforated plate, which is arranged in a front mouth of the discharge chamber. Further, the housing structure defines a back wall of the discharge chamber and a cylindrical wall of the discharge chamber, and the cylindrical wall defines an axis and has an outlet.

Typically, the discharge rotor is arranged to be rotatably driven in the discharge chamber, about the axis defined by the cylindrical wall, for discharging the comminuted meat from the discharge chamber, through an outlet of the cylindrical wall of the discharge chamber, via centrifugal force. Further, the discharge rotor has a hub, which has an annular flange extending radially from a back end of the hub, and the annular flange has an inner, circumferential edge and an outer, circumferential edge, which is close to but spaced by a circumferential gap from the circumferential wall. Moreover, the discharge rotor has fins extending radially from the hub, toward the circumferential edge of the annular flange, and axially from a front face of the annular flange, toward a front end of the hub.

Although such a discharge mechanism has proved to be generally satisfactory, it has been found that some of the comminuted meat tends to accumulate between a back face of the annular flange of the discharge rotor and the back wall of the discharge chamber, where the accumulating meat tends to cause smearing and its undesirable effects including protein degradation and increased friction, which can result in reduced throughput and undesirable increases in meat temperature.

As a matter of related interest, it has been known heretofore to draw a partial vacuum in such a meat-comminuting machine before the meat being comminuted reaches the discharge mechanism, so as to promote uniformity of the comminuted meat and so as to reduce oxidation in the comminuted meat.

This invention has resulted from efforts to improve such a discharge mechanism for a meat-comminuting machine so as to reduce smearing and the undesirable effects noted above and so as to permit a partial vacuum to be conveniently drawn in the discharge chamber.

SUMMARY OF THE INVENTION

This invention provides an improvement in a meat-comminuting machine comprising a discharge mechanism, which comprises a housing structure and a discharge rotor, as described above. According to the improvement provided by this invention, the discharge rotor has means provided on the back face of the annular flange for removing any comminuted meat tending to accumulate between the back face of the annular flange and the back wall of the discharge chamber.

In a preferred embodiment of this invention, the discharge rotor has a groove extending along the back face of the annular flange, toward the outer, circumferential edge of the annular flange. The groove defines means for removing any comminuted meat tending to accumulate between the back face of the annular flange and the back wall of the discharge chamber by displacing the tending-to-accumulate meat radially outwardly toward the outer, circumferential edge of the annular flange, via centrifugal force. Preferably, the groove is one of plural similar grooves extending along the back face of the annular flange, between the circumferential edges of the annular flange, and spaced from one another with generally uniform spacings around the back face of the annular flange.

In an alternative embodiment of this invention, the discharge rotor has a rib extending along the back face of the annular flange, toward the outer, circumferential edge of the annular flange. The rib defines means for removing comminuted meat tending to accumulate between the back face of the annular flange and the back wall of the discharge chamber by displacing the tending-to-accumulate meat radially outwardly toward the outer, circumferential edge of the annular flange, via centrifugal force. Preferably, the rib is one of plural similar ribs extending along the back face of the annular flange, between the circumferential edges of the annular flange, and spaced from one another with generally uniform spacings around the back face of the annular flange.

Preferably, in the preferred or alternative embodiment, the hub has a hollow portion, which opens backwardly toward the back wall of the discharge chamber. Preferably, moreover, the discharge mechanism is equipped with means including a tube extending into the discharge chamber, through a hole in the back wall of the discharge chamber, into the hollow portion of the hub for drawing a partial vacuum within the discharge chamber.

These and other objects, features, and advantages of this invention are evident from the following description of a preferred embodiment of this invention and an alternative embodiment thereof, with reference to the accompanying drawings.

DETAILED DESCRIPTION OF THE ILLUSTRATED EMBODIMENTS

Figure 1:
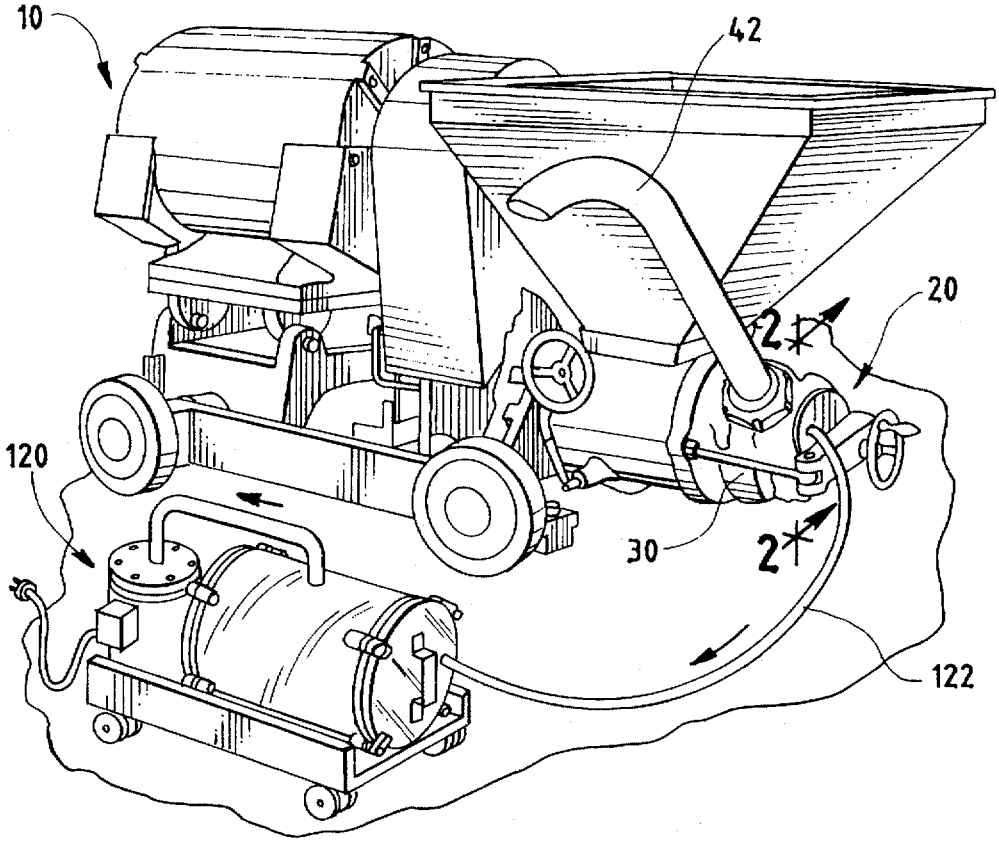
FIG. 1 is a perspective view of a meat-comminuting machine comprising a discharge mechanism embodying this invention.
Figure 3:
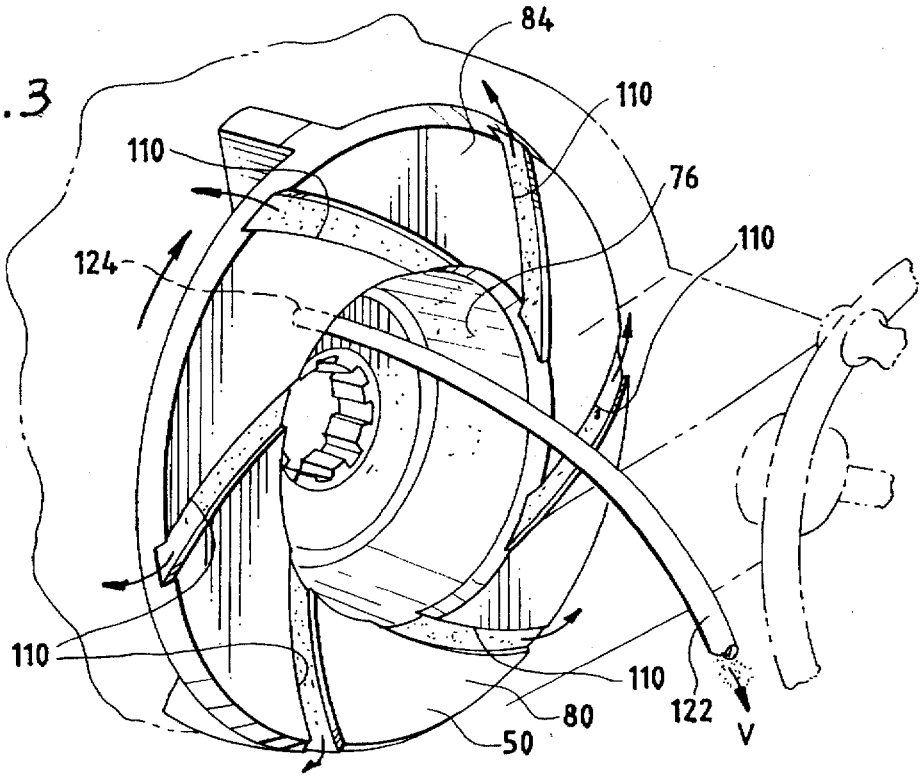
FIG. 3, on a similar scale, is a perspective view of a discharge rotor according to the preferred embodiment and a vacuum tube, as seen from the back and the near side of the discharge rotor. Some other elements of the discharge mechanism are shown in broken lines.

As shown in FIG. 1, this invention is embodied in a meat-comminuting machine 10 comprising a discharge mechanism 20. As compared to the discharge mechanisms of meat-comminuting machines known heretofore, the discharge mechanism 20 is improved so as to reduce smearing and the undesirable effects noted above.

Except as illustrated and described herein, the meat-comminuting machine is similar to a MINCE MASTER™ Model 225-100FD meat-comminuting machine, as available commercially from Mince Master Division of 2 M Tool Company, Inc. of Chicago, Ill., since 2 M Tool Company, Inc., acquired relevant assets from Griffith Laboratories U.S.A. of Chicago, Ill.

Figure 2:
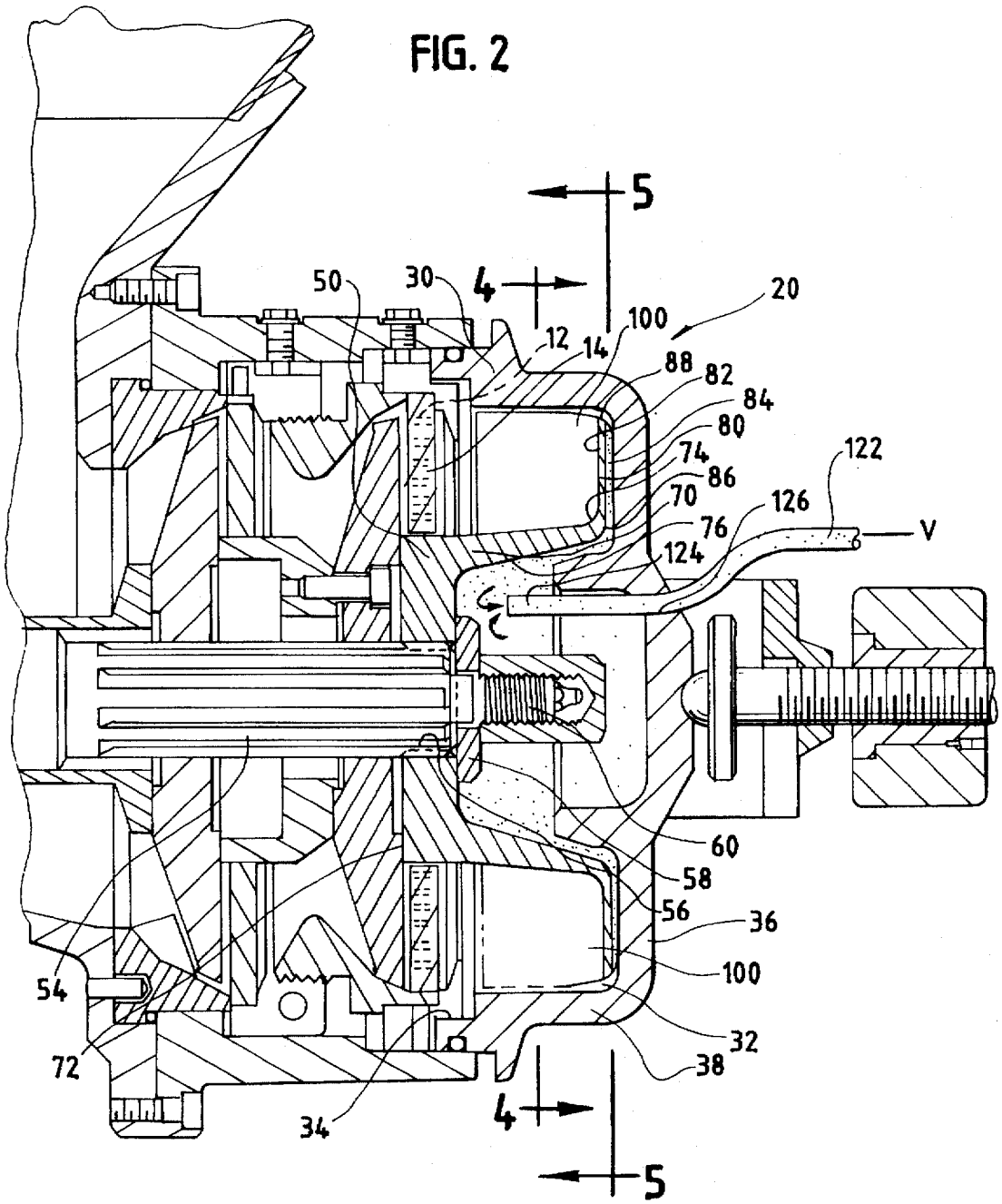
FIG. 2, on a larger scale, is a sectional view taken along line 2—2 of FIG. 1, in a direction indicated by arrows.
Figure 7:
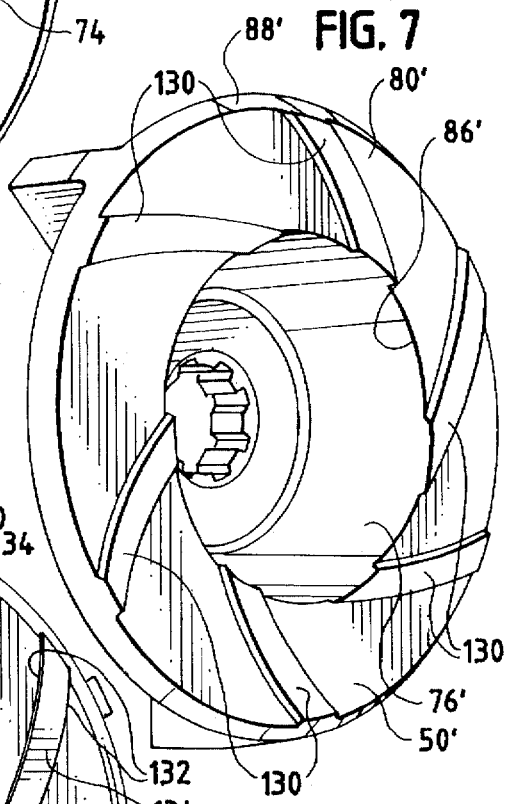
FIG. 7 is a perspective view of a discharge rotor according to the alternative embodiment, as seen from the back and the near side.
Figure 8:
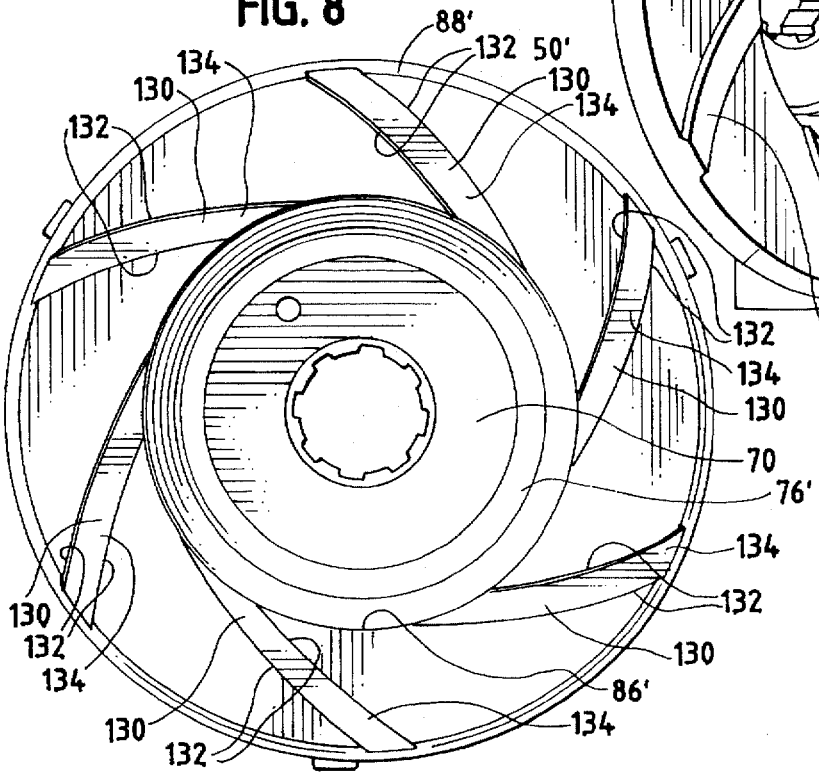
FIG. 8 is an axial elevation of the discharge rotor of FIG. 7, as seen from the back.

As shown in FIG. 2, the meat-comminuting machine 10 is arranged to force the comminuted meat through perforations 12 in a perforated plate 14, into the discharge mechanism 20. As shown in FIGS. 2 through 6, the discharge mechanism 20 comprises a housing structure 30 and a discharge rotor 50 according to the preferred embodiment of this invention. As shown in FIGS. 7 and 8, a discharge rotor 50' according to the alternative embodiment of this invention is useful where the discharge rotor 50 of FIGS. 1 through 6 is useful in the discharge mechanism 20. The discharge mechanism 20 including the discharge rotor 50 is to be next described.

Figure 4:
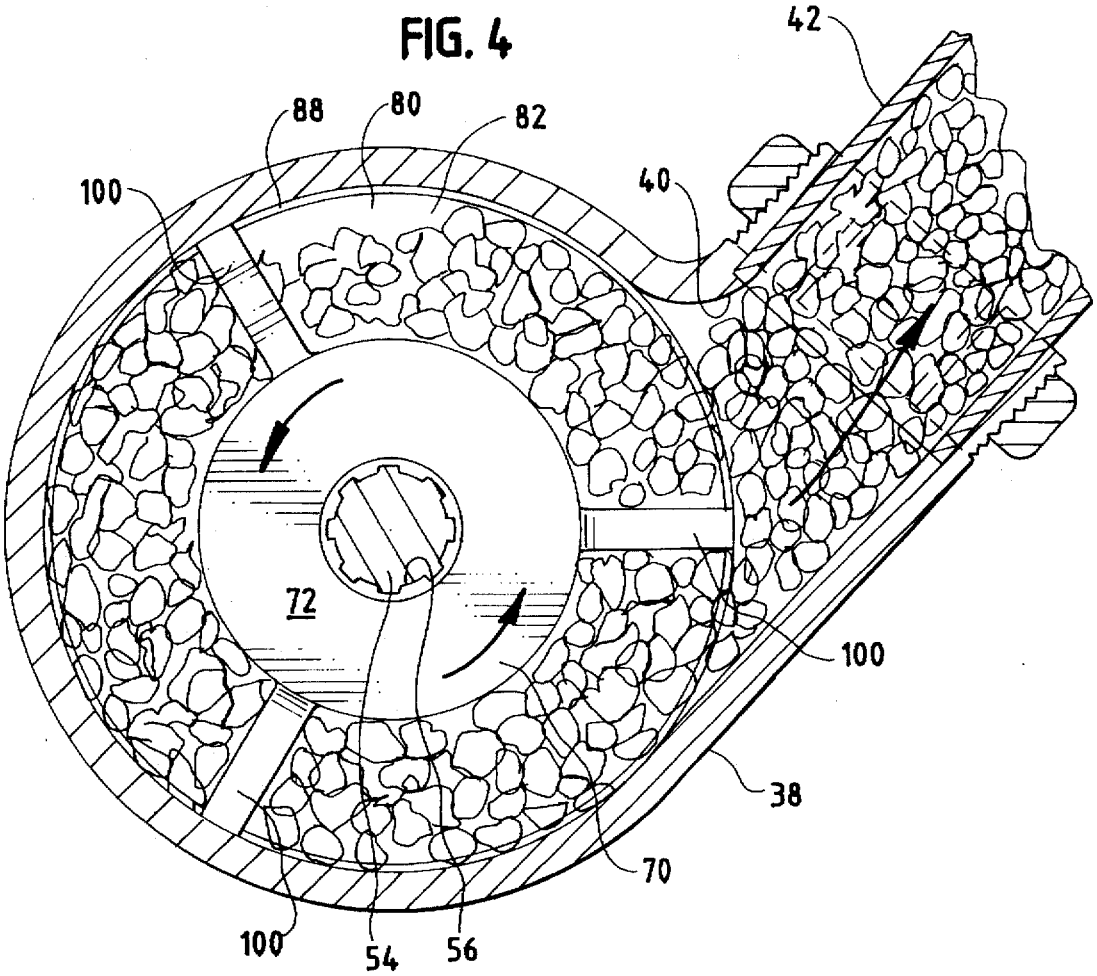
FIG. 4, on a similar scale, is a sectional view taken along line 4—4 of FIG. 2, in a direction indicated by arrows. Comminuted meat is shown in the discharge mechanism.
Figure 5:
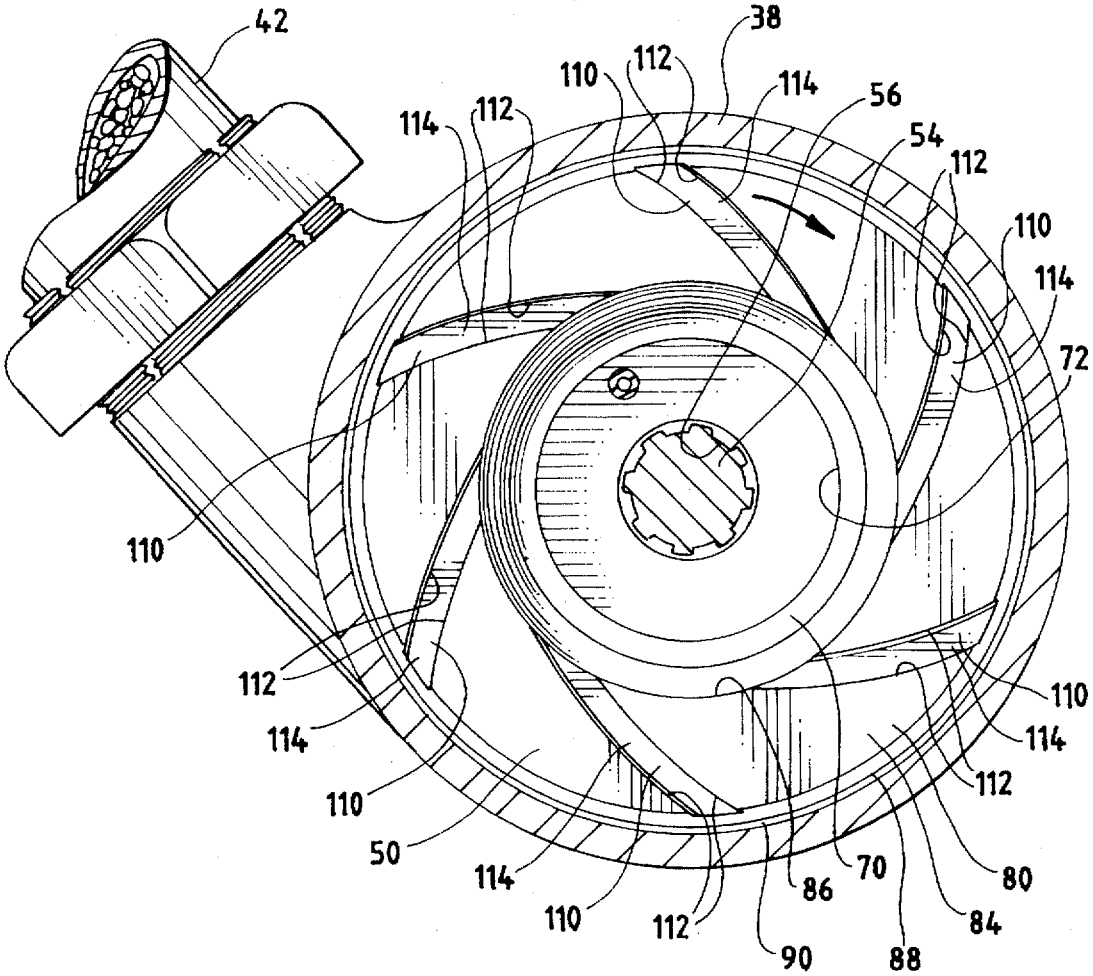
FIG. 5, on a similar scale, is a sectional view taken along line 5—5 of FIG. 2, in a direction indicated by arrows.
Figure 6:
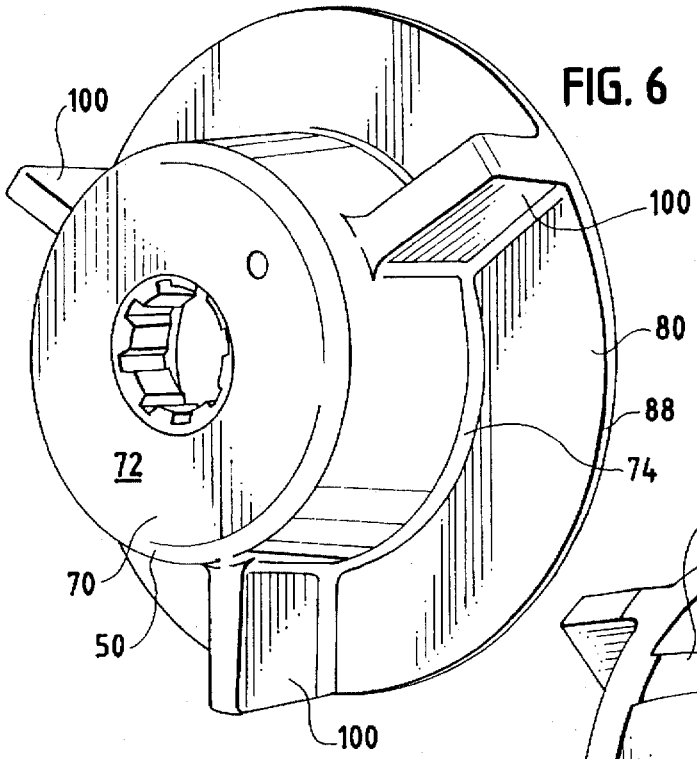
FIG. 6, on a similar scale, is a perspective view of the discharge rotor of FIG. 3, as seen from the front and the other side.

The housing structure defines a discharge chamber 32, which is adapted to receive comminuted meat from the perforated plate 14, which is arranged in a front mouth 34 of the discharge chamber 32. The housing structure 30 defines a back wall 36 of the discharge chamber 32 and a cylindrical wall 38 of the discharge chamber 32. The cylindrical wall 38 defines an axis and has an outlet 40, at which a discharge tube 42 is connected to the housing structure 30. The outlet 40 is shown in FIG. 4.

The discharge rotor 50 is arranged to be rotatably driven in the discharge chamber 32, about the axis defined by the cylindrical wall 38, via a motor (not shown) driving a splined shaft 54 fitting into a splined aperture 56 in the discharge rotor 50 and secured by a cap nut 58 on a threaded end 60 of the splined shaft 54. The discharge rotor 50 is arranged for discharging the comminuted meat from the discharge chamber 32, through the outlet 40 of the cylindrical wall 38 of the discharge chamber 32, via centrifugal force.

The discharge rotor 50 is machined from steel so as to have a hub 70, which has a front end 72 and a back end 74 and which has a hollow portion 76 opening backwardly toward the back wall 36 of the discharge chamber 32, and an annular flange 80 extending radially from the back end 74 of the hub 70. The annular flange 80 has a front face 82, a back face 84, an inner, circumferential edge 86, and an outer, circumferential edge 88, which is close to but spaced by a circumferential gap 90 from the circumferential wall 38 of the discharge chamber 32. The discharge rotor 50 has three similar fins 100 extending radially from the hub 70, toward the outer, circumferential edge 88 of the annular flange 80, and axially from the front face 82 of the annular flange 80, toward the front end 72 of the hub 70. The fins 100 are spaced from one another with generally uniform spacings around the discharge rotor 50. As shown in FIG. 4, the fins 100 drive the comminuted meat from the discharge chamber 32 into the discharge tube 42, via centrifugal force.

The discharge rotor 50 differs from discharge rotors known heretofore in that the discharge rotor 50 is machined so as to have six grooves 110 extending along the back face 84 of the annular flange 80, between the circumferential edges 86, 88. Each groove 110 extends along a spiral or scroll path, such that its inner end leads its outer end when the discharge rotor 50 is rotated properly, and has two side surfaces 112 and an inner surface 114. Along the side surfaces 112, the grooves 110 define means for removing any comminuted meat tending to accumulate between the back face 84 of the annular flange 80 and the back wall 36 of the discharge chamber 32 by displacing the tending-to-accumulate meat radially outwardly toward the outer, circumferential edge 88 of the annular flange 80, via centrifugal force. Moreover, because the tending-to-accumulate meat is displaced radially outwardly, the hollow portion 76 of the hub 70 tends to be substantially empty of any comminuted meat.

The discharge mechanism 20 is associated with a vacuum pump 120 and is equipped with a tube 122 having an inner end 124 extending into the discharge chamber 32, through a hole 126 in the back wall 36 of the discharge chamber 32, into the hollow portion 76 of the hub 70. The vacuum pump 120 and the tube 122 are used for drawing a partial vacuum within the discharge chamber 32. Because the hollow portion 76 of the hub 70 tends to be substantially empty of any comminuted meat, the inner end 124 of the tube 122 tends to remain unclogged as the partial vacuum is drawn.

In FIGS. 7 and 8, in which primed reference numbers refer to elements similar to elements referenced by similar, unprimed reference numbers in FIGS. 1 through 6, a discharge rotor 50' according to the alternative embodiment of this invention is shown, which is useful where the discharge rotor 50 is used in the discharge mechanism 20. The discharge rotor 50' differs from discharge rotors known heretofore and from the discharge rotor 50 in that the discharge rotor 50' is machined so as to have six ribs 130 extending along the back face 84' of the annular flange 80', between the circumferential edges 86', 88'. Each rib 130 extends along a spiral or scroll path, such that its inner end leads its outer end when the discharge rotor 50' is rotated properly, and has two side surfaces 132 and an outer surface 134. Along the side surfaces 132, the ribs 130 define means for removing any comminuted meat tending to accumulate between the back face 84' of the annular flange 80' and the back wall 36 of the discharge chamber 32 by displacing the tending-to-accumulate meat radially outwardly toward the outer, circumferential edge 88' of the annular flange 80', via centrifugal force. Moreover, because the tending-to-accumulate meat is displaced radially outwardly, the hollow portion 76' of the hub 70' tends to be substantially empty of any comminuted meat.

Various modifications may be made in the preferred and alternative embodiments illustrated and described herein without departing from the scope and spirit of this invention.

I claim:

1. In a meat-comminuting machine comprising a discharge mechanism, which comprises (a) a housing structure defining a discharge chamber adapted to receive meat comminuted by the meat-comminuting machine, through a front mouth of the discharge chamber, the housing structure defining a back wall of the discharge chamber and a cylindrical wall of the discharge chamber, the cylindrical wall defining an axis and having an outlet, and (b) means including a discharge rotor arranged to be rotatably driven in the discharge chamber, about the axis defined by the cylindrical wall, for discharging the comminuted meat from the discharge chamber, through the outlet of the cylindrical wall, via centrifugal force, the discharge rotor having a hub extending axially along the axis defined by the cylindrical wall, the hub having a front end and a back end, the discharge rotor having an annular flange extending radially from the back end of the hub, the annular flange having a front face, a back face, an inner, circumferential edge, and an outer, circumferential edge, which is close to but spaced by a circumferential gap from the circumferential wall, the discharge rotor having fins extending radially from the hub to the outer, circumferential edge of the annular flange, and axially from the front face of the annular flange, toward the front end of the hub, an improvement wherein the discharge rotor has a groove extending along the back face of the annular flange, between the circumferential edges of the annular flange, the groove defining means for removing any comminuted meat tending to accumulate between the back face of the annular flange and the back wall of the discharge chamber by displacing the tending-to-accumulate meat radially outwardly toward the outer, circumferential edge of the annular flange, via centrifugal force, wherein the hub has a hollow portion, which opens backwardly toward the back wall of the discharge chamber, and wherein the discharge mechanism is equipped with means including a tube extending into the discharge chamber, through a hole in the back wall of the discharge chamber, into the hollow portion of the hub for drawing a partial vacuum within the discharge chamber.

2. The improvement of claim 1 wherein the groove is one of plural similar grooves extending along the back face of the annular flange, between the circumferential edges of the annular flange, and spaced from one another with generally uniform spacings around the back face of the annular flange.

3. The improvement of claim 2 wherein the grooves extend along spiral paths.

4. In a meat-comminuting machine comprising a discharge mechanism, which comprises (a) a housing structure defining a discharge chamber adapted to receive meat comminuted by the meat-comminuting machine, through a front mouth of the discharge chamber, the housing structure defining a back wall of the discharge chamber and a cylindrical wall of the discharge chamber, the cylindrical wall defining and axis and having an outlet, and (b) means including a discharge rotor arranged to be rotatably driven in the discharge chamber, about the axis defined by the cylindrical wall, for discharging the comminuted meat from the discharge chamber, through the outlet of the cylindrical wall, via centrifugal force, the discharge rotor having a hub extending axially along the axis defined by the cylindrical wall, the hub having a front end and a back end, the discharge rotor having an annular flange extending radially from the back end of the hub, the annular flange having a front face, a back face, an inner, circumferential edge, and an outer, circumferential edge, which is close to but spaced by a circumferential gap from the circumferential wall, the discharge rotor having fins extending radially from the hub, toward the outer, circumferential edge of the annular flange, and axially from the front face of the annular flange, toward the front end of the hub, an improvement wherein the discharge rotor has a rib extending along the back face of the annular flange, between the circumferential edges of the annular flange, the rib defining means for removing any comminuted meat tending to accumulate between the back face of the annular flange and the back wall of the discharge chamber by displacing the tending-to-accumulate meat radially outwardly toward the outer, circumferential edge of the annular flange, via centrifugal force, wherein the hub has a hollow portion, which opens backwardly toward the back wall of the discharge chamber, and wherein the discharge mechanism is equipped with means including a tube extending into the discharge chamber, through a hole in the back wall of the discharge chamber, into the hollow portion of the hub for drawing a partial vacuum within the discharge chamber.

5. The improvement of claim 4 wherein the rib is one of plural similar ribs extending along the back face of the annular flange, between the circumferential edges of the annular flange, and spaced from one another with generally uniform spacings around the back face of the annular flange.

6. The improvement of claim 5 wherein the ribs extend along spiral paths.

7. In a meat-comminuting machine comprising a discharge mechanism, which comprises (a) a housing structure defining a discharge chamber adapted to receive meat comminuted by the meat-comminuting machine, through a front mouth of the discharge chamber, the housing structure defining a back wall of the discharge chamber and a cylindrical wall of the discharge chamber, the cylindrical wall defining an axis and having an outlet, and (b) means including a discharge rotor arranged to be rotatably driven in the discharge chamber, about the axis defined by the cylinder wall, for discharging the comminuted meat from the discharge chamber, through the outlet of the cylindrical wall, via centrifugal force, the discharge rotor having a hub extending axially along the axis defined by the cylindrical wall, the hub having a front end and a back end, the discharge rotor having an annular flange extending radially from the back end of the hub, the annular flange having a front face, a back face, an inner, circumferential edge and an outer, circumferential edge, which is close to but spaced by a circumferential gap from the circumferential wall, the discharge rotor having fins extending radially from the hub, toward the outer, circumferential edge of the annular flange, and axially from the front face of the annular flange, toward the front end of the hub, an improvement wherein the discharge rotor has means provided on the back face of the annular flange for removing any comminuted meat tending to accumulate between the back face of the annular flange and the back wall of the discharge chamber by displacing the tending-to-accumulate meat radially outwardly toward the outer, circumferential edge of the annular flange, via centrifugal force, wherein the hub has a hollow portion, which opens backwardly toward the back wall of the discharge chamber, and wherein the discharge mechanism is equipped with means including a tube extending into the discharge chamber, through a hole in the back wall of the discharge chamber, into the hollow portion of the hub for drawing a partial vacuum within the discharge chamber.

8. In a meat-comminuting machine comprising a discharge mechanism, which comprises (a) a housing structure defining a discharge chamber adapted to receive meat comminuted by the meat-comminuting machine, through a front mouth of the discharge chamber, the housing structure defining a back wall of the discharge chamber and a cylindrical wall of the discharge chamber, the cylindrical wall defining an axis and having an outlet, and (b) means including a discharge rotor arranged to be rotatably driven in the discharge chamber, about the axis defined by the cylindrical wall, for discharging the comminuted meat from the discharge chamber, through the outlet of the cylindrical wall, via centrifugal force, the discharge rotor having a hub extending axially along the axis defined by the cylindrical wall, the hub having a front end and a back end, the discharge rotor having an annular flange extending radially from the back end of the hub, the annular flange having a front face, a back face, an inner, circumferential edge, and an outer, circumferential edge, which is close to but spaced by a circumferential gap from the circumferential wall, the discharge rotor having fins extending radially from the hub to the outer, circumferential edge of the annular flange, and axially from the front face of the annular flange, toward the front end of the hub, an improvement wherein the hub has a hollow portion, which opens backwardly toward the back wall of the discharge chamber, and wherein the discharge mechanism is equipped with means including a tube extending into the discharge chamber, through a hole in the back wall of the discharge chamber, into the hollow portion of the hub for drawing a partial vacuum within the discharge chamber.

* * * * *